US005101810A

United States Patent [19]

Skille et al.

[11] Patent Number: 5,101,810

[45] Date of Patent: Apr. 7, 1992

[54] APPARATUS AND METHOD FOR THERAPEUTIC APPLICATION OF VIBRO-ACOUSTICAL ENERGY TO HUMAN BODY

[75] Inventors: Olav Skille, Steinkjer; Svein Sorsdal, Trondheim, both of Norway

[73] Assignee: Vibroacoustics A/S, Trondheim, Norway

[21] Appl. No.: 508,543

[22] Filed: Apr. 16, 1990

Related U.S. Application Data

[60] Division of Ser. No. 255,827, Oct. 7, 1988, abandoned, which is a continuation-in-part of Ser. No. 124,848, Nov. 18, 1987, abandoned.

[51] Int. Cl.[5] ..... A61H 1/00

[52] U.S. Cl. ..... 128/33; 128/64

[58] Field of Search ..... 128/33, 57, 64; 5/9 B; 84/651

[56] References Cited

U.S. PATENT DOCUMENTS

| | | | |
|---|---|---|---|
| 2,497,751 | 2/1950 | Wettlaufer | 128/33 |
| 3,235,891 | 2/1966 | Chade et al. . | |
| 3,446,204 | 5/1969 | Murphy | 128/33 |
| 3,556,088 | 1/1971 | Leonardini | 128/33 |
| 3,880,152 | 4/1975 | Nohmura | 128/33 |
| 4,023,566 | 5/1977 | Martinmaas | 128/33 |
| 4,046,081 | 9/1977 | Gutridge et al. | 5/9 B |
| 4,055,170 | 10/1977 | Nohmura | 128/33 |
| 4,064,376 | 12/1977 | Yamada | 128/33 |
| 4,535,760 | 8/1985 | Ikeda et al. | 128/33 |
| 4,538,596 | 9/1985 | Colasante | 128/32 |
| 4,630,519 | 12/1986 | Hirano et al. | 84/651 |
| 4,721,100 | 1/1988 | Hengl | 128/57 |

FOREIGN PATENT DOCUMENTS

| | | | |
|---|---|---|---|
| 618053 | 1/1986 | Japan | 23/02 |
| 1165541 | 10/1969 | United Kingdom . | |
| 1251498 | 10/1971 | United Kingdom . | |

OTHER PUBLICATIONS

Wigram and Weeks, A Project Evaluating the Difference in Therapeutic Treatment Between the Use of Low Frequency Sound and Music, and Music Alone in Reducing High Muscle Tone in Multiply Handicapped People, and Oedema in Mentally Handicapped People, VibroAcoustics, 1989.

Skille, "Vibroacoustic Therapy", Music Therapy, 1989, vol. 8, No. 1, pp. 61–77.

A report from Haperbury Hospital, England.

A report from the insurance company Kansa in Finland.

A report from the Pedegogical Instittue of Tallinn in Esthonia.

*Primary Examiner*—Edgar S. Burr

*Assistant Examiner*—Aaron J. Lewis

*Attorney, Agent, or Firm*—Cushman, Darby & Cushman

[57] ABSTRACT

Apparatus for therapeutic application of vibro-acoustic energy to a human body, including a closed box with at least one sound opening in which is arranged a loudspeaker directed towards a part of the body. Upholstery is disposed between the box and the body at the location of the loudspeaker and has air passages. Low frequency signals are supplied to the loudspeaker and to one or a plurality of external loudspeakers. Music is supplied to the external loudspeakers. The low frequency signals are influenced either in step with the music, in a predetermined relation to the music, or in predetermined rhythm. As a storage medium for sound there may be used a tape cassette or compact disc in which at least one of the sound channels contains the influenced low frequency signal in the frequency range 30–120 Hz and the remaining sound channels contain pure music.

12 Claims, 6 Drawing Sheets

APPARATUS AND METHOD FOR THERAPEUTIC APPLICATION OF VIBRO-ACOUSTICAL ENERGY TO HUMAN BODY

This is a division of application Ser. No. 07/255,827, filed Oct. 7, 1988, which was abandoned upon the filing hereof which was a continuation-in-part of application Ser. No. 07/124,848, abandoned.

BACKGROUND OF THE INVENTION

The present invention relates to an apparatus and a method for applying sound to a human body for producing therapeutic effects.

The present invention starts out with three basic principles within musical therapy, namely, that low (deep) tones appear to be relaxing, whereas high tones appear to be stressing; that rhythmic music appears to be activating, whereas nonrhythmic music appears to be passivating; and that a high sonic level appears to be aggressive, whereas a low sonic level appears to be passivating.

These basic principles have general validity, but there are exceptions. The basic principles have appeared through extensive therapeutic observation of patients over a long period.

Musical therapy is based on music being perceived through the acoustic channels of perception.

SUMMARY OF THE INVENTION

The present invention is based on a realization by the inventors that music, directly transferred to the human body through vibration receptors in the nervous system may have a greater effect, i.e. be able to provide greater degree of muscular relaxation. By joining acoustical perception and vibrational perception into a general experience, there is according to the present invention obtained a therapeutical effect which has an influence both on physical and psychical sufferings of patients. This combination is for sake of simplicity in this description denoted by the term vibroacoustics.

The vibro-acoustical principle assumes best possible transfer of sound both to ear and body. The acoustic part may be taken care of by one or a plurality of good loudspeakers, or a headset. For the vibrational part, there is, according to the invention, provided a device using the transfer of sound from a loudspeaker, through the air, to the human body in an efficient manner.

BRIEF DESCRIPTION OF THE DRAWINGS

The principles of the invention will be further discussed with reference to the drawings wherein preferred embodiments are shown. The specifics illustrated in the drawings are intended to exemplify, rather than limit, aspects of the invention as defined in the claims.

IN THE DRAWINGS

Figure 1:
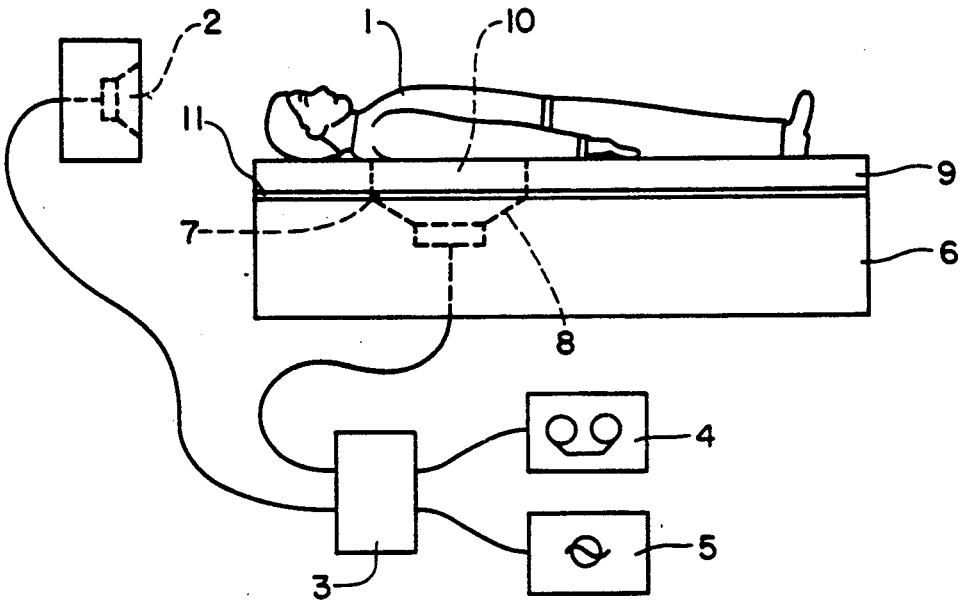
Figure 2:
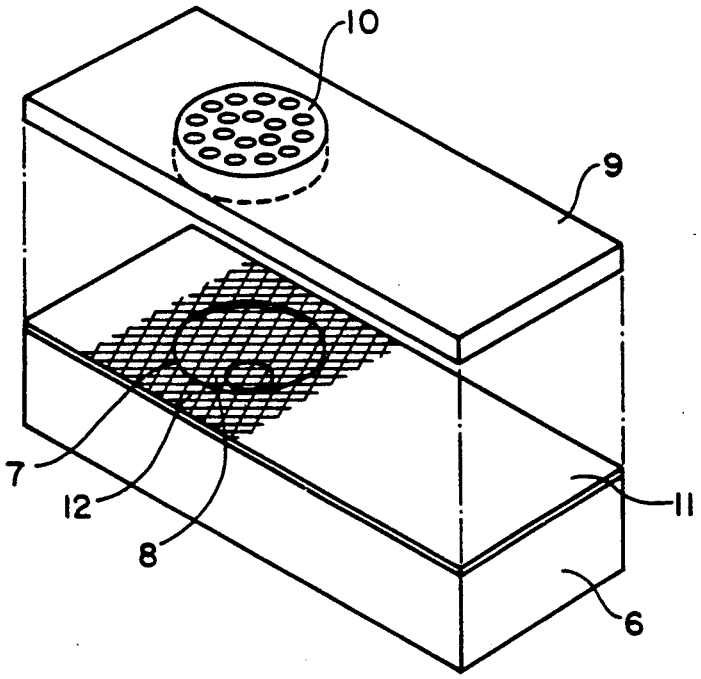
Figure 3:
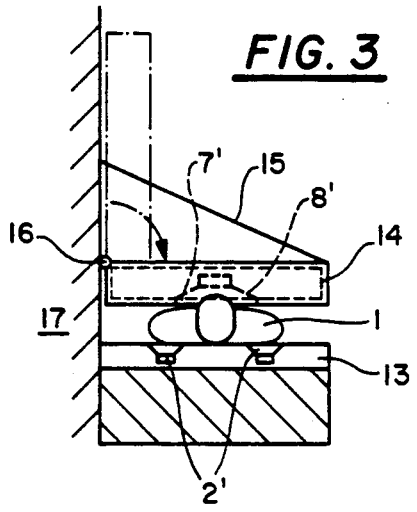
Figure 4:
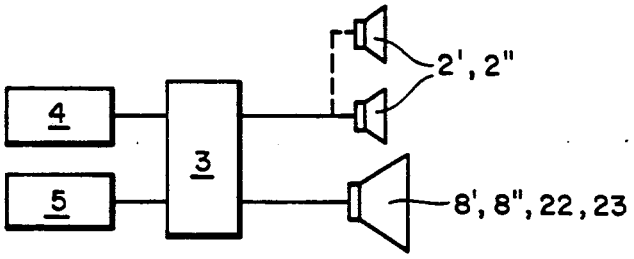
Figure 5:
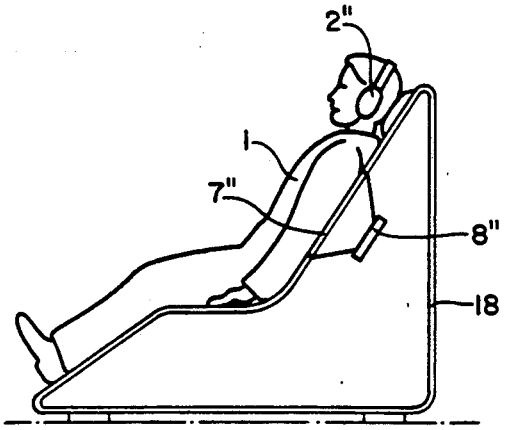
Figure 6:
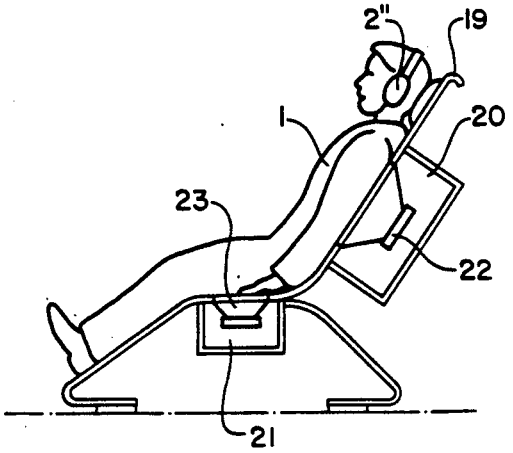

FIG. 1 is a schematic view of a practice of the principles of the present invention using apparatus embodying principles of the present invention;

FIG. 2 is a partly-exploded perspective view of the low frequency sonic applicator device of the apparatus;

FIG. 3 is a schematic view of a second embodiment of the apparatus shown in FIG. 1;

FIG. 4 is a block diagram of the functional units of the apparatus of FIG. 3 (as well as of the apparatus of FIGS. 5 and 6);

FIG. 5 is a schematic view of a third embodiment of the apparatus shown in FIG. 1; and FIG. 6 is a schematic view of a fourth embodiment of the apparatus shown in FIG. 1.

Figure 7:
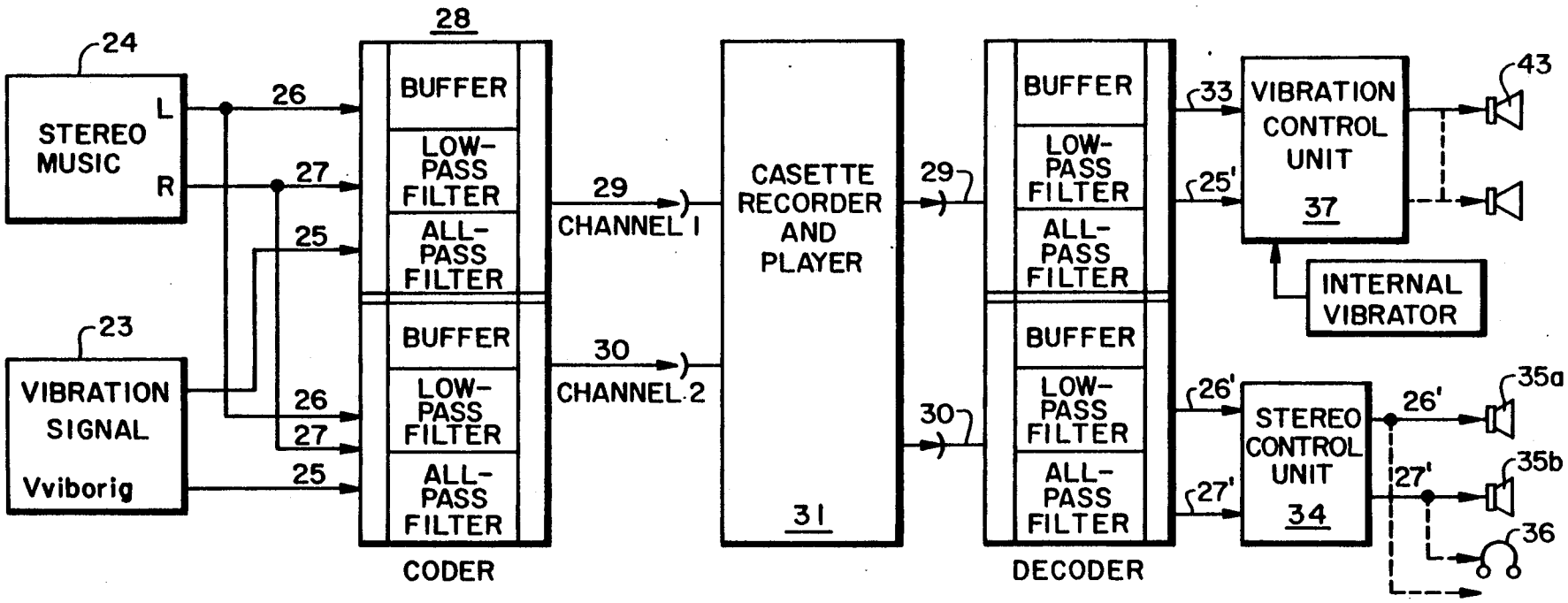
Figure 8:
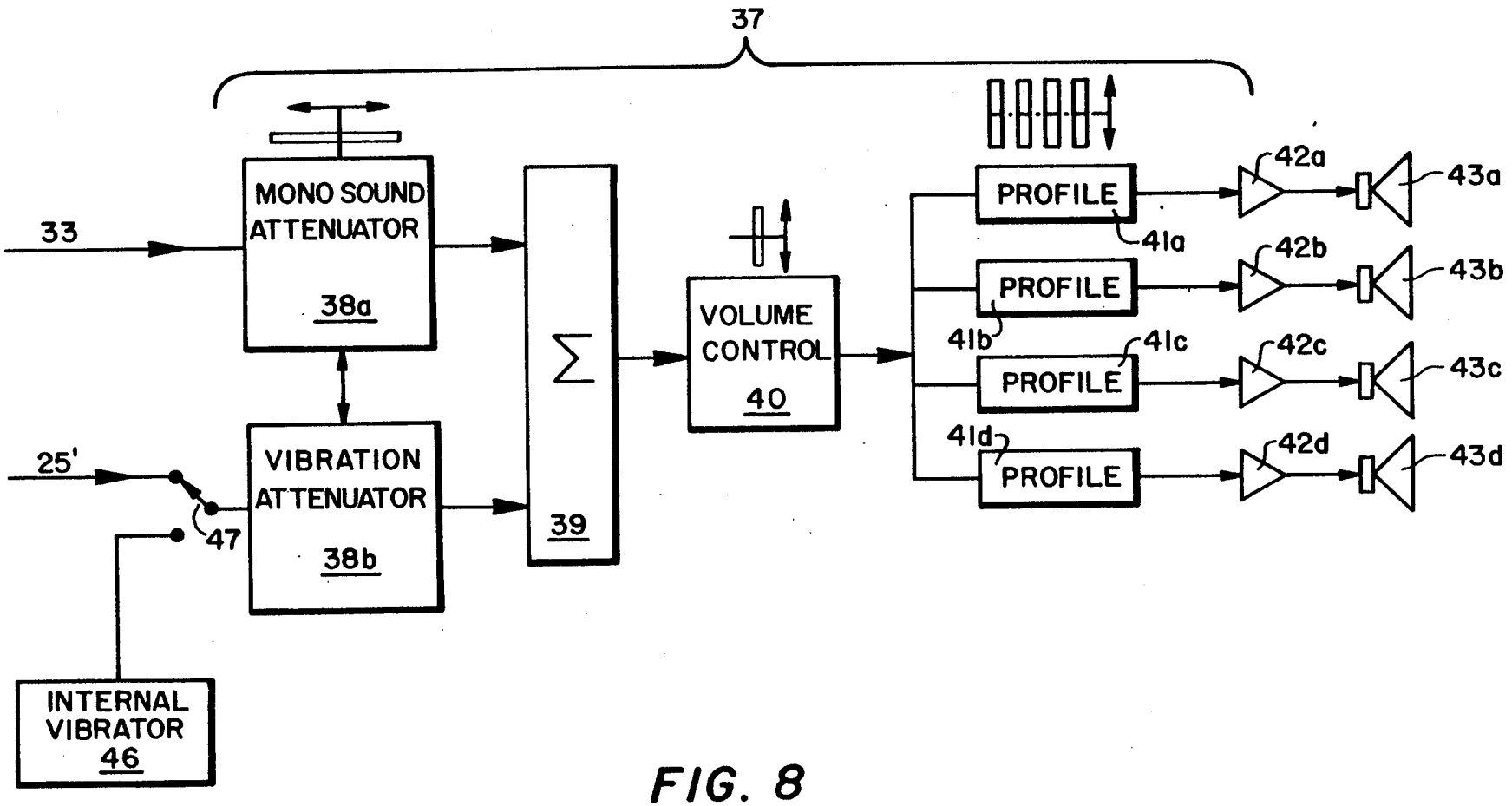
Figure 9:
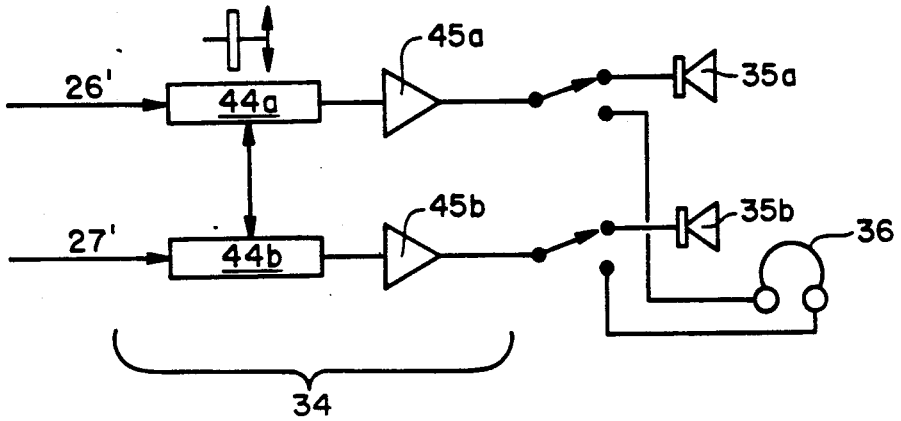
Figure 10A:
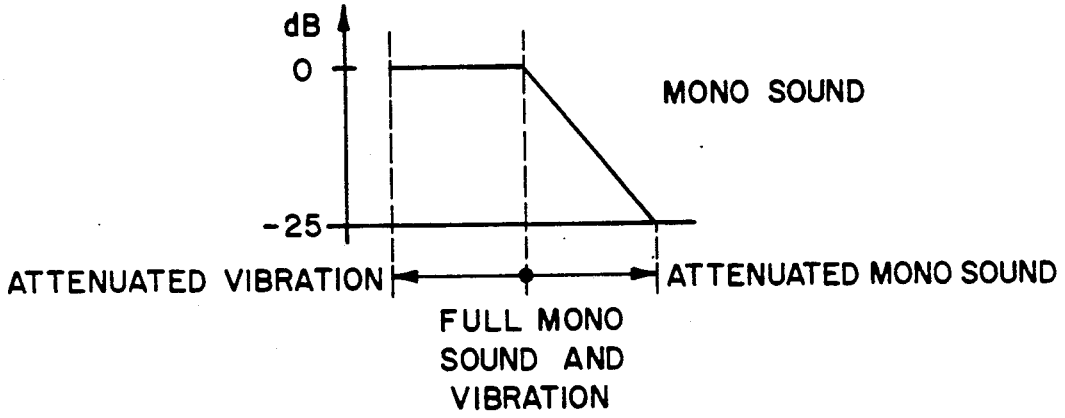
Figure 10B:
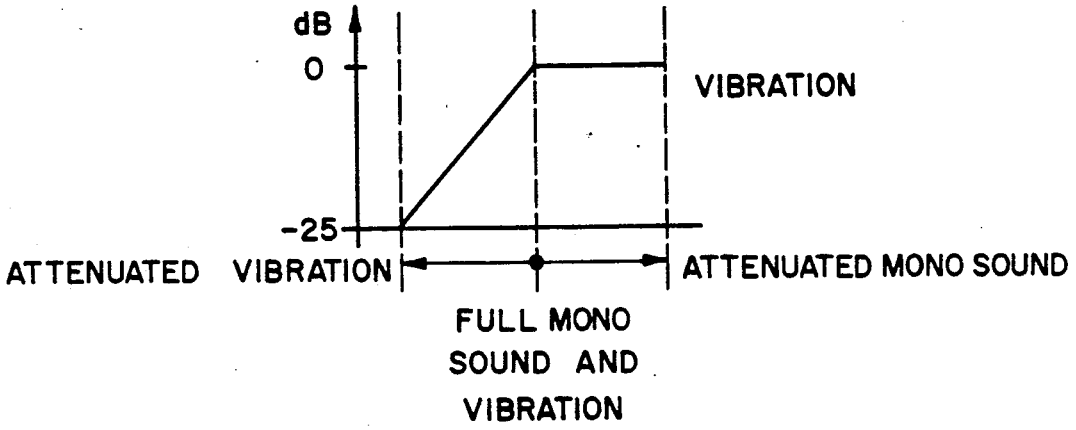
Figure 11:
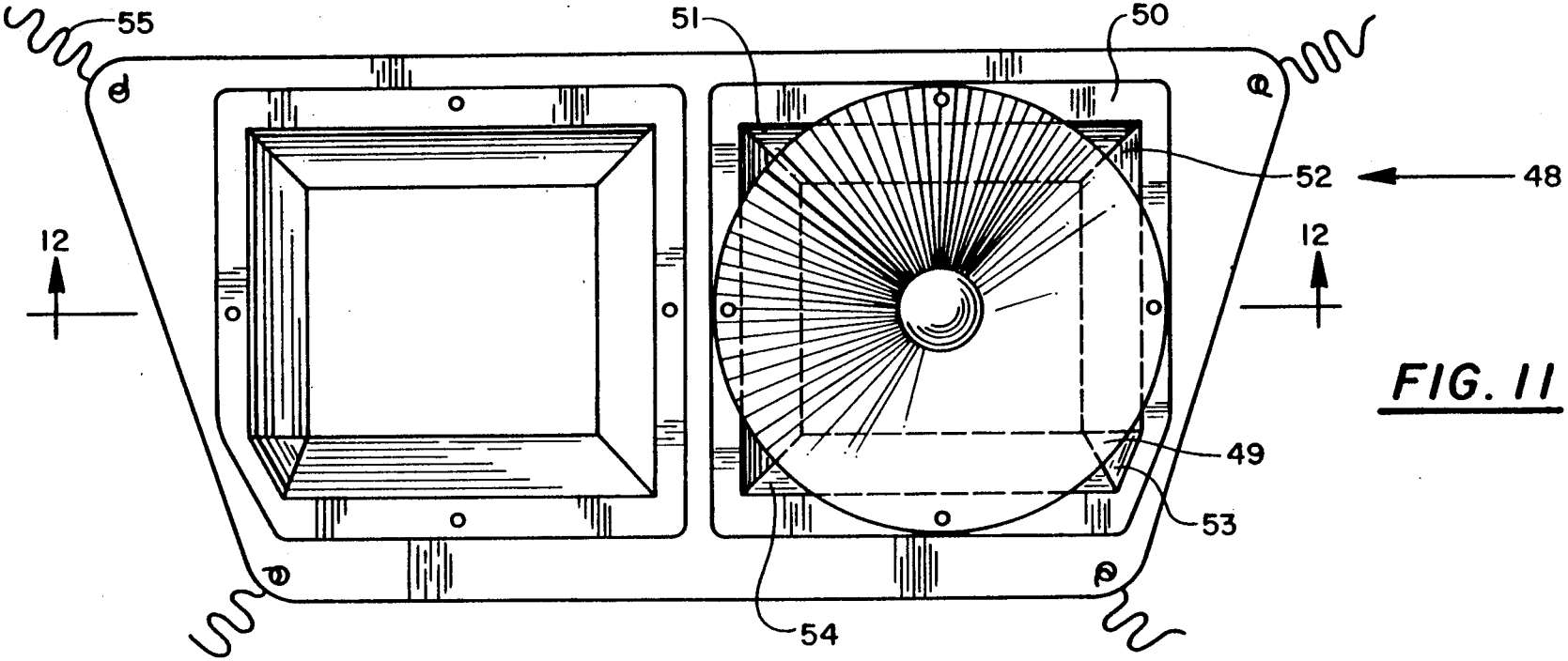
Figure 12:
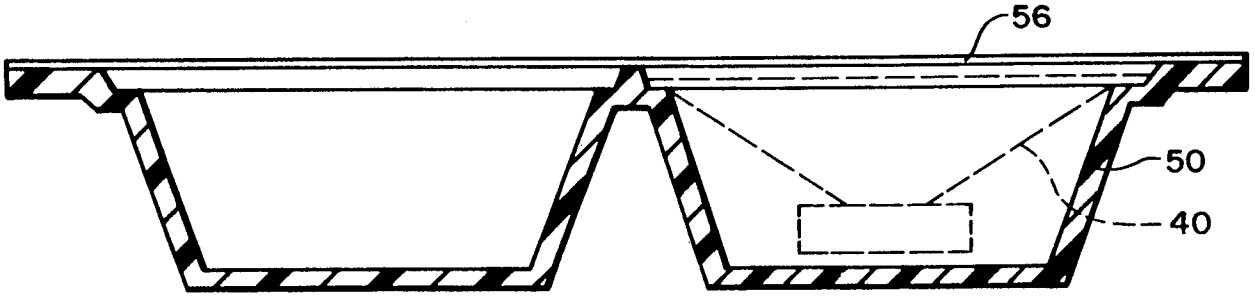

FIG. 7 illustrates, in block schematic form, apparatus for recording of processed input signals, and for playback of deprocessed signals;

FIG. 8 is a block schematic diagram of a signal processing unit for mixing mono sound and vibration signals;

FIG. 9 is a stereo music control unit;

FIGS. 10*a* and 10*b* are diagrams illustrating mixing of mono sound and vibration signals;

FIG. 11 illustrates a preferred loudspeaker unit for mono sound and vibration signals; and FIG. 12 is a cross-sectional view taken on line 12—12 of FIG. 11.

DETAILED DESCRIPTION

In FIG. 1, there is shown a human body 1 placed on a closed box 6 being provided with at least one sound opening 7 in which is arranged a loudspeaker 8 being directed towards the upper part of the body 1. An upholstery 9 has been located between the box 6 and the body 1, the portion 10 located opposite the loudspeaker 8 allowing good air passage. The top 11 of the box 6, which in the case shown forms a mattress bottom, could e.g. be made of plywood, said sound opening 7 being made in the top 11. To prevent possible damage to the loudspeaker 8, a protective grille 12 could be placed across the opening 7. In order to attenuate the radiation of sound to the surroundings and to prevent acoustical short-circuit, the foundation, i.e. the box 6, is designed as a closed box. The upholstery 9 could be made from foamed plastics or foamed rubber having closed cells. Mattresses filled with air or light spheres of plastics (e.g. Styropor ®) could also be utilized. In the mattress or the upholstery 9 there is, as mentioned, arranged a region 10 corresponding to the sound opening 7. The region 10 could be perforated, like the opening 7, or possibly be filled with foamed plastics having large open cells, and which permits air passage. The foamed plastics will provide a certain supporting ability, in particular, as it will be supported by the protective grille, simultaneously with providing good air passage. The person is placed such that the part of the body to be influenced is lying opposite the opening 7 and the region 10. The diaphragm of the loudspeaker 8 will thereby be connected to the body 1 through the air being present in said opening 7 and the region 10. The upholstery itself will act as a sealant to make the coupling between the loudspeaker 8 and the body 1 as efficient as possible. When the loudspeaker 8 is supplied with signals of suitable frequency content and strength, the diaphragm will move and thereby put the body into low frequency movement.

An audio amplifier with at least two sound channels has at least one output connected to the loudspeaker 8 and at least a second output connected to a loudspeaker 2 for music. The signals to the amplifier 3 are delivered from, e.g. a tape cassette player or compact disc player 4, and from a signal generator 5. The signal generator 5 is arranged to deliver sinusoidal tones, impulses or other synthetic signals. The player 4 is able to be provided with a storage medium, e.g. tape cassette or compact disc containing suitable program material. The storage medium could have two or a plurality of sound channels, where at least one of the sound channels contains low frequency signals, preferably in the frequency range 30–12 Hz being superimposed by music. The remaining sound channel(s) of the storage medium contain, however, only pure music. The storage medium could be arranged to provide stereophonic or quadrophonic music. Thus, it is here and in the description below to be understood that the signal generator 5, in effect, could be constituted by one or a plurality of the storage medium channels. The amplifier 3 could possibly be provided with a low pass filter (not shown) for feeding the loudspeaker 8.

Thus, it is to be understood that the loudspeaker 8 is either supplied with a pure low frequency in the frequency range 30–120 Hz, or is modulated as a function of the music being output from the loudspeaker 2, or that the sound appearing on the loudspeaker 8 contains low frequency signals within the frequency range superimposed on the music which also appears on the loudspeaker 2. In this case the signal generator to the amplifier 3 is primarily the player 4.

By repeated tests, it has been found that the vibro-acoustic frequency range where the sound spreading in the human body appears to have the greatest effect, measured objectively and experienced subjectively, lies between 30 and 120 Hz, preferably in the range 40–90 Hz. Particular good results are obtained within the octave 40–80 Hz. Outside the frequency range 30–120 Hz, one will subjectively have no substantial feeling of vibrational influence.

The therapeutical effect is obtained by placing the person in the most suitable manner and as close to the vibration loudspeaker, in the example shown the loudspeaker 8, as possible, and a pleasant distance from the loudspeaker 2 delivering the music. The therapeutical apparatus includes the following previously briefly discussed parts, namely, the vibration parts 6, 7, 8, 10 forming the transfer device intended to transfer sound within the vibro-acoustic frequency range.

The acoustic part, in the form of one or a plurality of wide-band loudspeakers 2 of HiFi-quality, or a set of headphones for transfer of music, being adapted to the frequencies which are used in the vibration part, a multi-channel amplifier 3 which through at least on channel transmits sinusoidal oscillations (vibration) an filtered music to the vibration part 8. Non-filtered music is sent through the other channel(s) to the loudspeaker(s) 2 delivering music, the strength of the sound being variable in step-free fashion on the respective channels, and a multi-channel tape player, preferably a conventional two-channel tape player 4, where, on one track of the tape cassette there is recorded pure music intended for the music loudspeaker 2. On the other track, there is recorded a specific mixture of music and low frequency sound, e.g. sinusoidal signals. The sinusoidal signals are caused to beat by means of a dual-recording technique which was specially developed to be used with the therapeutic system, providing so-called superimposed sinusoidal waves, and the signal generator 5 is arranged to be adjusted individually with regard to therapeutical effective low frequencies which are to be supplied to the loudspeaker 8, provided that these are not already supplied from the player 4.

It should be readily understood that, although there is shown only one loudspeaker 2 and one loudspeaker 8, it is within the scope of the invention to provide two or a plurality of music loudspeakers 2, and two or a plurality of low frequency loudspeakers 8 may be used. If two or a plurality of loudspeakers 8 are used, there will be a necessity for a corresponding number of openings 7 and regions 10, respectively.

When prerecorded software is used and delivered from the player 4, the signal generator 5 is thus not required, but the signal generator 5 is required if one wishes to compose suitable software and for possible further development thereof. The signal generator may also be desirable for the object of research and for typical medical treatment.

In FIG. 3, it is shown how the box of FIG. 1 could be replaced by a differently-design loudspeaker box 14, with a loudspeaker 8' which may be turned-down about, e.g., a hinge 16 from a vertical position (shown in dot-dashed lines) to a horizontal position (shown in solid lines). In order to ensure that the loudspeaker box 14 lies in the horizontal position, it may be secured by wire, strap or the like 15 which, at one end, is attached to a wall 17 similar to the hinge 16 and, at its other end, is attached to an outer portion of the loudspeaker box 14. When a person is to be exposed to the influence of sound, the person lies down on a bench 13 of conventional design per se, for instance, shaped like the bench 6,9 in FIG. 1. The external loudspeakers 2' could be arranged, e.g., in the bench 13 itself, or in some other suitable manner, e.g., such that the person 1 obtains a good stereophonic sound image therefrom. After the person 1 has thus reclined on the bench 13, either with their face upwards or downwards, the loudspeaker box 14 with the loudspeaker 8' is turned down to the horizontal position as shown in FIG. 3. The loudspeaker 8' corresponds in function to the loudspeaker 8 in FIG. 1. In FIG. 5 is shown a variant in which the person 1 sits in a reclinable furniture article 18 which is designed as a closed box, but with a sound opening for a loudspeaker 8'', which, in function, is the same as the loudspeaker 8 in FIG. 1 or the loudspeaker 8' in FIG. 3. Similar to the embodiment in FIG. 1, there is, in front of the loudspeaker 8, provided a sound opening 7''. A corresponding sound opening 7' is found in FIG. 3.

In the example of FIG. 5, the external loudspeakers have been indicated by the reference numeral 2'', shown here in the form of a headset. However, it should be readily understood that the external loudspeakers may have any suitable design and/or positioning without that being considered as limitative to the scope of the invention.

In the example of FIG. 6, there is shown a modification of the embodiment of FIG. 5. A reclinable furniture article 19 is here used being constructed in conventional manner, e.g., from a framework with upholstered surfaces for reclinement of the user. There may be used one or a plurality of loudspeakers, housed in cabinets, in order to influence the body of the person 1. In the non-limitative example of the invention, as shown, there has been used two loudspeaker cabinets 20, 21. Each of these could, instead, consist of two adjacent separate loudspeaker cabinets, for possible better adaptation to the reclinable furniture. However, it is important that the loudspeaker cabinets be of a closed type to prevent noise externally and to prevent acoustic shortcircuiting. The loudspeaker cabinets are, in a known manner, provided with loudspeakers 22 23 and can be attached to the framework of the reclinable furniture by means of brackets, straps or the like.

As in FIG. 5, the person 1 may use headphones 2'' as external loudspeakers.

It is also understood that the external loudspeakers 2' in FIG. 3 could be replaced by headphones.

In FIG. 4 there is, in block diagram form, shown the functional structure of the devices of FIGS. 3 and 5, however, corresponding to that which is shown in FIG. 1.

At an institution for multi-handicapped patients having impaired psychic development, it was discovered that vibro-acoustical treatment gave a spasm-resolving effect at a frequency of about 40 Hz. The spasm-resolving effect was so dominant that the patients were more easily available for manipulating physiotherapy after, or while still under vibro-acoustical influence.

Control tests were made with the opening angle of the spastic limbs with and without the use of music. A marked difference of the opening angle as a result of the influence of music was clearly shown.

The present device was also experimentally used on the following conditions:

Rett's Syndrome: The "plucking" movements reduced in frequency. The patient could even fall into sleep and a noticeable relaxative effect was observed. (Rett's syndrome is named after Dr. Andreas Rett of Austria.)

Autism: Contact-rejecting patients were so concerned about the effect of vibration that they could allow the personnel to give more skin contact/skin stimulation than without this influence. One can here visualize the contours of a therapy scheme in which adaptation to contact under vibro-acoustical influence could be transferred to situations where the music could be gradually attenuated or possibly could disappear.

Spastic conditions: Effect as indicated above, with clear spasmolytical effect in the lower frequency regions.

Vibro-acoustical influence was also attempted on personnel at the institution for different conditions of discomfort. The following observations were made:

Neck/shoulder pains: Such pains, either of the myalgic type, or as a result of stress of different cause, was eased substantially at particular frequencies, in particular at about 68 Hz. Repeated treatments, i.e., up to 10 treatments of 30 minutes each, proved to provide relief of longer duration.

Lumbago: Pains in the lower back region were relieved at particular frequencies, in particular at about 50 Hz. For pains caused by muscular tensions, relief of longer duration upon repeated treatments was observed.

Menstrual pains: Premenstrual pain and tension and the like proved to be relievable by using a particular frequency, 52 Hz. Treatments each day in the "acute" phase as well as once per week in the middle phase, repeated over 2–3 periods appeared to provide the desired effect for a longer duration.

Asthma: Vibro-acoustical treatment at about 50 Hz appeared to provide an effect which aids the patient to loosen and expel phlegm from the air passages.

During tests carried out on persons in a local area, the following was observed:

Stress-induced depression: A dramatic positive effect was observed after the first treatment which lasted for approximately 30 minutes. The positive effect is dependent on both frequency (68 Hz) and the choice of music. The successful treatment was terminated after 10 treatments. during the last treatments, there was used a variety of frequency ranges and activating music.

Athletic injuries: The treatment has provided a good result. Both acute muscular trauma and post-operative convalescence has reacted positively to the sequence 40/60/80/60/40 Hz with approximately 6 minutes duration per frequency. Muscles and tendons in a tensioned state are released and are stretchable with lesser discomfort than without vibroacoustical treatment.

Rheumatism: Long-term treatment (10 to 20 treatments) with a frequency of 68 and 86 Hz has provided a lasting improvement for patients with rheumatic pains and/or damage due to wear. The treatment was provided daily or every other day, with a duration of 30 minutes.

Muscular cramps: Upon cramping in a muscle, dissolvement of the cramp condition was observed at a frequency 40/60 Hz after approximately 2 minutes.

General stress-discomfort: Tuned frequency and music in an environment shielded from the outside world during a period of 30 minutes provided a stress-dissolving effect and appeared to supply the person with new vitality.

The above observations are of purely empirical kind, based on the observations made by the therapist, together with the descriptions by the tested persons of the experiences they have had during and after the treatments.

It will be immediately understood that the sound box with upholstery shown on the drawings is only meant to serve as an example to elucidate the invention without thereby representing any limitation of the invention as defined in the claims. Thus, the devices shown could be designed in any suitable manner to provide the best possible effect on the patients.

In addition to the storage medium for sound, it should be remarked that a beating sinusoidal tone is made by recording, on top of a primary frequency, a secondary frequency having a deviation of 0.2 to 2 Hz. "The beat velocity" should be present and should be tuned to the quality of the music which is required to be used in addition to the low frequencies. The beat program is then recorded on one of the two tracks on the storage medium, e.g. a tape cassette, sound-on-sound with the selected, preferably filtered, music. Pure music is recorded on the other track. As previously mentioned, one could use, e.g., all four tracks on the tape cassette by using a sound head adapted thereto, to improve the reproduction of sound (e.g., 2-channels), and possibly to extend the beat program.

According to the invention, program material to be used with a vibro-acoustic chair, bed or bench is specially composed or adapted to the object of the invention. From the point of view of the composer, the program is in two parts, namely:

1. A low frequency sound/vibration signal 23 which is suitably made by combining two pure tones having a small difference in frequency.

2. A music signal 24 which is partly reproduced through a headset, earphones or external, suitably small loudspeakers 2', 2'' in stereo, and partly added to the sound/ vibration-signal in mono.

Technically speaking, there are three independent signals, i.e. one signal 25 for part 1 and two signals 26, 27 (stereo, left 26 and right 27) for part 2.

An important aspect of the invention is that the three signals, by suitable "coding" in a coding means 28, are converted into two signals 29 and 30, so that they are recordable by means of a tape cassette recorder/player 31 on a dual channel tape cassette, and are "decoded" by a decoding means 32 back into three signals 25', 26', 27' plus an optional mono signal 33 upon playback. That mono signal is the mono version of the music signals from the tape cassette. It is suitably added to the vibration signal in selected ratio before being introduced to loudspeakers in the chair, bed or bench.

The coding-decoding process is made such that it takes into consideration the frequency content of the signals and what is known about perception of stereo reproduction. The major point is that one renounce on possible stereo information in the reproduced music at low frequencies, and the music signal is there forced into mono (in-phase). The vibration signal is recorded in anti-phase added to the processed music signal. It is retrieved upon playback, independent of the music signal. The music signal contains stereo information at higher frequencies where no vibration signal is recorded. It is considered commonly recognized within psycho-acoustics that a subjective stereo impression of a music signal will be maintained under such conditions.

The coding-decoding process is illustrated in general block schematic form in FIG. 7.

The symbols to be used below are:

Vlc—signal to left channel on cassette

Vrc—signal to right channel on cassette

Vlorig—left channel of original music signal

Vrorig—right channel of original music signal

Vviborig—vibration signal (modulated low frequency tone)

Vlmus—left channel of the reproduced music signal

Vrmus—right channel of the reproduced music signal

Vsound—mono version of reproduced music signal, to be used with the reproduced vibration signal Vvib—reproduced vibration signal Aapc—transfer function of allpass filter for coding Arpc—transfer function of lowpass filter for coding Aapd—transfer function of allpass filter for decoding Alpd—transfer function of lowpass filter for decoding A detailed explanation of the functioning of allpass filters and lowpass filters within the coder means and decoder means is believed to be superfluous. Such filters have been indicated for reference by 28', 28'' and 32', 32'' in the coder and decoder means, respectively. The lowpass filters should, e.g. be of third order Butterworth type.

Allpass filters have two poles and two zeroes. The amplification is unity at all frequencies. The slope of the phase curve is steepest at frequency f0c and f0d, respectively.

The set of formulas for allpass filters is:

$$s=j\cdot 2\cdot\pi\cdot f$$

$$wac=2\cdot\pi\cdot f0c$$

$$swac=s/wac$$

$$\text{Aapc}=(\text{swac}^2-swac+1)/(swac^2+swac+1)$$

$$wad=2\cdot\pi\cdot f0d$$

$$swad=s/wad$$

$$Aapd=(swad^2-swad+1)/swad^2+swad+1)$$

The symbols:

j—imaginary unit f—frequency f0c—frequency of steepest phase curve at coding, f0c=330 Hz fOd—frequency of steepest phase curve at decoding, f0d=220 Hz The lowpass filter has three poles. It has Butterworth characteristic. The amplification is unity (1) at low frequencies. The cut-off frequency is fc and fd, respectively.

The set of formulas is:

$$wc=2\cdot\pi\cdot fc$$

$$wd=2\cdot\pi\cdot fd$$

$$Alpc=wc^3/[(s+wc)(s^2+s\cdot wc+wc^2)]$$

$$Alpd=wd^3/[(s+wd)(s^2+s\cdot wd+wd^2)]$$

The symbols:

fc—cut-off frequency at coding, fc=300 Hz fd—cut-off frequency at decoding, fd=200 Hz the music 24 is suitably in the form of stereo signals 26 and 27, i.e. 26 related to Vlorig and 27 related to Vrorig. The vibration signal 23 is delivered as a signal 25 related to Vviborig. Through coding in the coding means 28, using a separate set of filters 28', 28'' and a buffer 28''' for each channel, the output on 29 will be:

$$Vlc=Vlorig(Aapc/2-Alpc/4)+Vrorig\cdot Alpcc/4-Vviborig/2$$

The output on 30 will be:

$$Vrc=Vrorig(Aapc/2-Alpc/4)+Vlorig\cdot Alpc/4+Vviborig/2$$

These two signals are intermediately storable on the two tracks of a conventional tape cassette or other recording means and are output again as signals 29, 30 to be input to the decoder means 32.

Three major signals are output from the decoder means 32, namely, a left channel signal of music 26' related to Vlmus, a right channel signal of music related to Vrmus, and vibration 25' related to Vvib. In addition, the mono signal of music is on 3, related to Vsound. These signals will have the following form:

$$Vlmus=Vlc\cdot(Aapd-Alpd/2)+Vrc\cdot Alpd/2$$

$$\text{Vrmus}=\text{Vrc}\cdot(Aapd-Alpd/2)+Vlc\cdot Alpd/2$$

$$Vvib=Vrc\cdot Alpd-Vlk\cdot Alpd$$

$$Vsound=Vlc\cdot Aapd+Vrc\cdot Aapd$$

The invention is now to be further explained by reference to FIGS. 8 and 10, with a brief reference to FIG. 7.

The outputs 26' and 27' being left and right stereo channels of reproduced music, respectively are delivered to a conventional control unit 34 for balance setting, volume control and amplification. The stereo music is delivered to external loudspeakers **35*a* and 35*b*, or to a headset or earphones 36**, known per se.

The outputs 33 and 25' being a mono version Vsound of the music and the output vibration signal Vvib, respectively are fed to a vibration control unit 37 having means **38*a*, 38*b* to balance between music and vibration in a selected proportion, means 39 to combine the outputs from said balancing means 38, means 40 to control the magnitude of output from said combining means, means 41 to selectively give the output signal a desired frequency profile or profiles (as with a frequency equalizer) and delivering the output signal or signals therefrom to one or a plurality of loudspeakers 43 via associated power amplifiers 41**.

From FIG. 8 and FIG. 10, it is seen that the balancing subunit 38*a* has an attenuation profile like that of FIG. 10*a*. Further, the balancing subunit 38*b* has an attenuation profile like that of FIG. 10*b*. The two balancing subunits are ganged with a common balance control. Thus, moving the balance control to on side will yield attenuated vibration signal and non-attenuated music signal. Moving the balance control towards the other side will gradually cause the portion of vibration signal to increase towards 0 dB attenuation and vibration signal to increase towards 0 dB attenuation and remain thereat, whereas the music signal will start to be attenuated once the vibration signal reaches the 0 dB state.

In certain situation, the operator of the present invention may wish to set the vibration signal independent of the vibration signal Vviborig which originally was supplied. This may be the case where the operator chooses to modify the prerecorded vibration signal available in both signals 29 and 30. This can be done by disconnecting signal 25' and connecting an internal vibration unit 46 delivering a set vibration frequency to the subunit 38*b* via switch 47.

The cassette recorder and player 31 could be any commercially available high quality unit.

From FIG. 9 it is noted that the stereo control unit is of conventional type having volume and balance subcontrol units 44*a*, 44*b* for left and right channels and respective amplifiers 45*a* , 45*b* to feed loudspeakers 35 or headset/earphones 36.

FIG. 11 illustrates a preferred embodiment of a loudspeaker unit 48 for reproducing vibration signal and mono sound. FIG. 12 is a section 12—12 in FIG. 11 through the loudspeaker unit. Although two loudspeaker 49 could be used in the unit shown, only one is shown for sake of clarity. The loudspeaker 49 is filled into a cup-shaped box 50 of inverted trapezoid cross-section and having a substantially square outline in plan view, as seen from FIG. 11. By virtue of the round or oval construction of the loudspeaker membrane, there are obtained air passages 51, 52, 53 and 54 between the loudspeaker periphery and the corners of said box 50. When these air passages are substantially blocked by the human body when the person to be treated is, e.g. lying on the bench, the effect of low frequencies is increased, whereas the low frequency vibration signals are attenuated when no person is covering the unit 48, simply because signals from the membrane reflected by the box pas through said passages will be in antiphase with the signals coming out from the front of the membrane. However, the basic technique is well documented in the literature, but the construction of the loudspeaker unit, according to the invention, is believed to be novel.

In order to concentrate the sonic energy (vibration signal plus mono sound) toward the body at the sound openings 7, see FIG. 1, and to prevent vibration energy to be transferred to the chair, bench or bed framework and thereby create an unwanted source of noise it is proposed to attach the unit 48 to the frame work by elastic members such as rubber bands or springs 55. A grid 56 is suitably located on top of the unit 48 (not included in FIG. 11) to prevent accidental damage to the loudspeaker 49 membrane.

It should now be apparent that the apparatus and method for therapeutic application of vibro-acoustical energy to human body, as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for providing vibroacoustic therapy to a patient, comprising:

(a) providing a treatment station including:

a pair of first loudspeakers arranged to transfer acoustic energy through the air to the patient's respective ears;

a box having at least on sound opening, each sound opening being closed by a second loudspeaker, said box being otherwise substantially closed;

the box having a patient-confronting portion including said sound opening, said patient-confronting portion being externally upholstered with upholstery which is open in a region corresponding to each said sound opening;

an amplifier;

at least one input device serving said amplifier with input signals corresponding to at least:

(a) a one left channel of musical sounds;

(b) one right channel of musical sounds; and (c) a pattern of regular vibrations;

said amplifier processing said inputs and thereby serving said loudspeakers of said pair of first loudspeakers and each said second loudspeaker respectively with:

(i) a signal corresponding to a left channel of a musical sounds served to one of said first loudspeakers;

(ii) a signal corresponding to a right channel of musical sounds served to the other of said first loudspeakers;

(iii) a pattern of regular vibrations in the range of 30–120 Hz served to each said second loudspeaker;

(b) disposing a patient in a physical contact with said upholstery on said box so that a portion of the patient's body seals substantially acoustically with the box perimetrically of each said sound opening, and the patient's left and right ears are respectively located within earshot of said one and other loudspeakers of said pair of first loudspeakers;

(c) while conducting step (b), operating said at least one input device and said amplifier so as to expose the patient's left and right ears respectively to musical sounds from said pair of first loudspeakers, and said portion of the patient's body to application thereto of said pattern of regular vibrations from said at least one second loudspeaker;

while conducting step (c), serving each said second loudspeaker with a signal corresponding to a combination of said left and right channels of musical sounds, superimposed upon said pattern of regular vibrations;

varying the amplitude of said signal corresponding to a combination of said left and right channels of musical sounds and relative to the amplitude of said pattern of regular vibrations;

said input device being a recorder served by a recording having at least two tracks, including (i) one track on which said input signals corresponding to said left channel of musical sounds is recorded, and (ii) another track on which said input signals corresponding to said right channel of musical sounds is recorded;

said input signals corresponding to a pattern of regular vibrations being superimposed by recording on only one of said two tracks.

2. The method of claim 1, wherein:

said pattern of regular vibrations as applied to said portion of the patient in step (c) consists of vibrations having frequencies in the range of 40–90 Hz.

3. The method of claim 1, wherein:

said pattern of regular vibrations as applied to said portion of the patient in step (c) consists of vibrations having frequencies in the range of 40–80 Hz.

4. A method for providing vibroacoustic therapy to a patient, comprising:

(a) providing a treatment station including:

a pair of first loudspeakers arranged to transfer acoustic energy through the air to the patient's respective ears;

a box having a least one sound opening, each sound opening being closed by a second loudspeaker, said box being otherwise substantially closed;

the box having a patient-confronting portion including said sound opening, said patient-confronting portion being externally upholstered with upholstery which is open in a region corresponding to each said sound opening;

an amplifier;

at least one input device serving said amplifier with input signals corresponding to at least:

(a) one left channel of musical sounds (b) one right channel of musical sounds; and (c) a pattern of vibration signals, said amplifier processing said inputs and thereby serving said loudspeakers of said pair of first loudspeakers and each said second loudspeaker respectively with:

(i) a signal corresponding to a left channel of musical sound signal served to one of said first loudspeakers;

(ii) a signal corresponding to a right channel of musical sound signal served to the other of said first loudspeakers;

(iii) a pattern of vibration signals in the range of 30–120 Hz served to each said second loudspeaker;

(b) disposing a patient in physical contact with said upholstery on said box so that a portion of the patient's body seals substantially acoustically with the box perimetrically of each said sound opening, and the patient's left and right ears are respectively located within earshot of said one and other loudspeakers of said pair of first loudspeakers;

(c) while conducting step (b), operating said at least one input device and said amplifier so as to expose the patient's left and right ears respectively to musical sounds from said pair of first loudspeakers, and said portion of the patient's body to application thereto of said pattern of regular vibrations from said at least one second loudspeaker;

while conducting step (c), serving each said second loudspeaker with a signal corresponding to a combination of said left and right channels of musical sounds, superimposed upon said pattern of regular vibrations;

varying the amplitude of said signal corresponding to a combination of said left and right channels of musical sounds and relative to the amplitude of said pattern of vibration signals;

said input device being a recorder served by a recording having at least two tracks, each including elements of left and right channel musical sound signals and a low frequency vibration signal including (i) one track on which there is recorded said input signals corresponding to a composite signal containing allpass minus lowpass elements of said left channel musical sound signal plus a lowpass element of said right channel musical sound signal minus an element of said low frequency vibration signal, and (ii) another track on which there is recorded said input signals corresponding to a signal containing allpass minus lowpass elements of said right channel musical sound signal plus a lowpass element of said left channel musical sound signal plus an element of said low frequency vibration signal.

5. The method of claim 4, wherein:

said pattern of vibration signals as applied to said portion of the patient in step (c) consists of vibrations having frequencies in the range of 40–90 Hz.

6. The method of claim 4, wherein:

said pattern of vibration signals as applied to said portion of the patient in step (c) consists of vibrations having frequencies in the range of 40–80 Hz.

7. The method of claim 4, said operating step comprising:

playing back of said one and another track composite signals by means of said recorder, applying said one and another track composite signals to a decoder means within said amplifier having two inputs to receive said composite signals, and having at least three outputs, delivering from said three outputs converted restructured first and second channel musical sound signals and converted restructured vibration signals, respectively; and outputting said converted restructured vibration signal as said pattern of vibration signals to said second loudspeaker and outputting said converted restructured first and second channel musical sound signals as said signals corresponding to said left and right channel musical sound signals to said first loudspeakers.

8. A method according to claim 7, wherein:

said at least three outputs also include a fourth output, and wherein a converted, restructured mono sound signal based on a combination of said first and second channel musical sound signals is delivered to said second loudspeaker.

9. A method according to claim 7, wherein:

said converted restructured first channel musical sound signal is constituted by allpass minus lowpass elements of said first channel composite signal plus a lowpass element of said second channel composite signal, said converted restructured second channel musical sound signal is constituted by allpass minus lowpass elements of said second channel composite signal plus a lowpass element of said first channel composite signal, and said converted restructured vibration signal is constituted by a lowpass element of said first minus said second channel composite signals.

10. A method as claimed in claim 8, wherein:

said converted restructured mono sound signal is constituted by an allpass element of said first plus said second channel composite signals.

11. A method as claimed in claim 8, said operating step further comprising:

balancing said converted, restructured output signals to control the ratio between the amplitude of said restructured mono sound and vibration signals in a composite signal thereof to be applied to said second loudspeaker.

12. A method according to claim 9, comprising:

subjecting said converted restructured signals to a frequency equalization to give said restructured vibration and mono sound signals a selected frequency profile.

* * * * *

UNITED STATES PATENT AND TRADEMARK OFFICE

CERTIFICATE OF CORRECTION

PATENT NO. : 5,101,810

DATED : April 7, 1992

INVENTOR(S) : Olav Skille, et al

It is certified that error appears in the above-indentified patent and that said Letters Patent is hereby corrected as shown below:

On title page, item [60] after "abandoned" insert --PCT/NO87/00023 filed Mar. 18, 1987--

Item [30] Foreign Application Priority Data insert the following:

-- Mar. 19, 1986 [NO] Norway 861060
Nov. 21, 1986 [EP] Europe 86116165.1--

Signed and Sealed this

Twelfth Day of April, 1994

Bruce Lehman

*Attest:*

BRUCE LEHMAN

*Commissioner of Patents and Trademarks*

*Attesting Officer*